United States Patent [19]

Kramer

[11] 4,423,601

[45] Jan. 3, 1984

[54] WATER DEFROST EVAPORATOR WITH NON-UNIFORM WATER DISTRIBUTION

[76] Inventor: Daniel E. Kramer, 2009 Woodland Dr., Yardley, Pa. 19067

[21] Appl. No.: 283,969

[22] Filed: Jul. 16, 1981

[51] Int. Cl.[3] ..... F25D 21/12

[52] U.S. Cl. ..... 62/82; 62/80; 62/282

[58] Field of Search ..... 62/282, 82, 80; 165/95

[56] References Cited

U.S. PATENT DOCUMENTS

| | | | |
|---|---|---|---|
| 175,291 | 3/1876 | Lount | 62/82 |
| 2,149,990 | 3/1939 | Cook | 62/282 X |
| 2,219,393 | 10/1940 | McAdam . | |
| 2,300,085 | 10/1942 | Yunker | 62/282 X |
| 2,378,964 | 6/1945 | Williams . | |
| 2,480,346 | 8/1949 | Watts . | |
| 2,524,568 | 10/1950 | Kritzer . | |
| 2,527,368 | 10/1950 | McGrath . | |
| 2,607,202 | 8/1952 | Garland . | |
| 3,828,570 | 8/1974 | Stutz | 62/82 X |

*Primary Examiner*—Albert J. Makay
*Assistant Examiner*—Henry Bennett
*Attorney, Agent, or Firm*—Daniel E. Kramer

[57] ABSTRACT

An air cooling evaporator for use in refrigeration systems under conditions where frost is deposited on the cooling surfaces having a drain pan positioned under the cooling surface and a water distributing pan positioned over the cooling surface. The water distributing pan has as a distribution device holes positioned in the bottom of the pan, with the holes so positioned or sized that more water is distributed to the portions of the coil adjacent the tube sheets and less water to the central portion of the coil.

4 Claims, 5 Drawing Figures

WATER DEFROST EVAPORATOR WITH NON-UNIFORM WATER DISTRIBUTION

BACKGROUND OF THE INVENTION

1. Field of the Invention

This invention relates to air cooling evaporators intended for operation with refrigerant temperatures below freezing under which condition it is expected that air, cooled by the evaporator, will precipitate moisture in the form of frost on the colder-than-freezing refrigerating surfaces.

The invention is further directed towards means for defrosting the frosted surfaces periodically between periods of refrigeration by distributing water at a temperature above 0° C. from a supply over the uppermost portion of the coil on which frost has collected.

In brief, the field of the invention is "a water defrost evaporator".

2. Associated Art

Though water defrost evaporators have been made by the Krack Company and by the Recold Refrigeration Company and by the Frick Company, and though the inventor is aware of U.S. Pat. No. 2,527,368 by McGrath, and U.S. Pat. No. 2,607,202, by Garland, and U.S. Pat. No. 2,219,393, by McAdam, and U.S. Pat. No. 2.480,346 by Watts, and U.S. Pat. No. 2,524,568 by Kritzer, and U.S. Pat. No. 2,649,695 by Kohlstedt, and U.S. Pat. No. 1,908,573 by Sulzberger, and U.S. Pat. No. 2,081,479 by Fink, none of these provide the features or solve the problems set forth herein.

BRIEF SUMMARY OF THE INVENTION

In an air cooling evaporator there is a finned coil section and a fan positioned to blow air over the coil section; and a drain pan positioned under the coil section. Since it is intended to utilize the coil under conditions where frost is deposited on the refrigerating surfaces, it is desirable to provide means for defrosting the frosted surfaces. This invention is directed toward a coil which includes a distributing pan positioned over the coil. When defrost is required, refrigeration is stopped and water is supplied to the distributing pan from a pipe and numerous holes are provided at the bottom of the distributing pan to better ensure that water is distributed uniformly over the top face of the coil. Because the ends of the coil are more active heat transferwise than the center of the coil and therefore accumulate proportionately more frost than the center of the coil, the distributing pan incorporates means such as a greater density of holes for distributing more water onto the coil adjacent the tube sheets than in the center of the coil. It is an object of this arrangement to see that the frost deposited on each portion of the coil is defrosted at such a rate that the defrost of all portions of the coil is completed substantially simultaneously. Achieving substantially simultaneous completion of defrost of all coil surfaces requires the advantages of ensuring the shortest possible defrost time and ensuring the coldest average water temperature traversing the coil.

The shortened defrost time achieved through the application of this invention allows more effective refrigerating time for the equipment and therefore acts to increase the effective capacity of the refrigeration system. The defrosting evaporator adds heat to the freezer because its temperature is higher than the freezer temperature. The amount of heat added is directly proportional to the defrost duration. This improvement, which shortens defrost duration, reduces the heat input to the freezer and thereby correspondingly reduces the energy required to drive the compressor by that amount needed to run the compressor for a period required to remove the excess heat added to the freezer by evaporators not utilizing this invention.

More frost is usually deposited at the ends of finned coils than at its center portion. This is because half the tubes at the coil ends are fed with evaporating liquid refrigerant which has been agitated by traversing an adjacent U-bend. (The other half of the tubes near the coil ends are fed with quiescent evaporating liquid which has traversed the straight tubes in the coil fin pack). The agitated liquid refrigerant, for a short distance after traversing the U-bend, completely coats the interior of the coil tube and causes it to be a more effective heat transfer surface, thereby presenting colder surfaces to the moist air being cooled and causing deposition on the coil of more frost at both ends than at the coil center section.

DETAILED DESCRIPTION OF THE INVENTION

Figure 1:
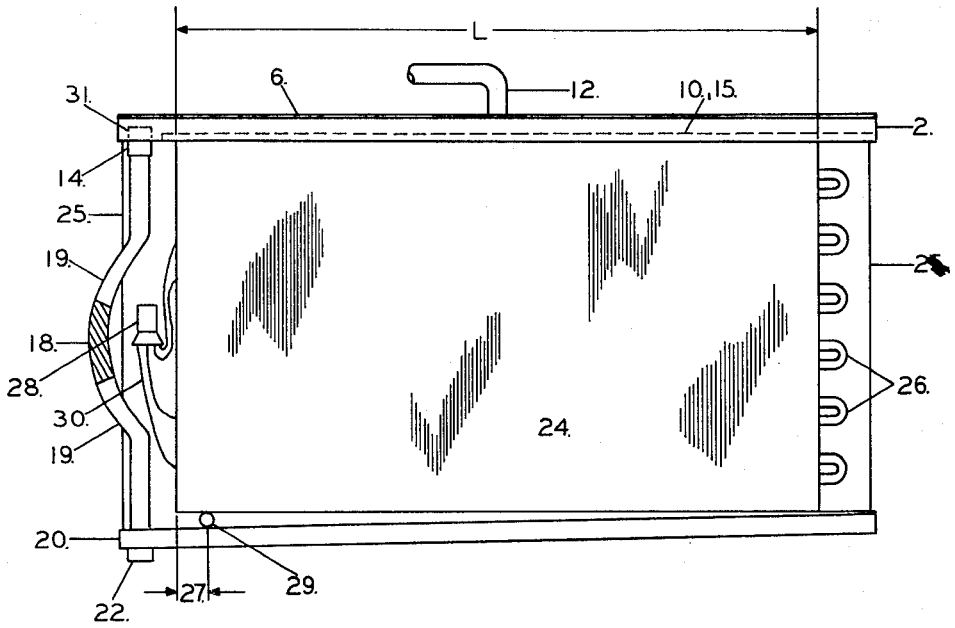
FIG. 1 is a front view of the evaporator with elbow guards removed showing the coil, the water distribution pan, the drain pan, and the overflow pipe with its transparent section arranged in a position that would be visible to an operator.

FIG. 1 is a front elevation of a water defrost evaporator embodying the invention. Fin pack 24 constitutes the heat transfer portion of the coil including fins, and tubes to which refrigerant is distributed by distributor 28 and distributor tubes 30. The tubes are joined at their ends by U bends 26. The coil length L is divided into a number of portions (a-h) of arbitrary length (unit coil portions) which may accumulate frost at different rates. When, after a period of operation, the fin and tubes are frosted, the operation of the refrigerating system and the evaporator fans (34 in FIG. 2) is stopped and hot water is supplied through inlet pipe 12 to distribution pan 2, through distribution holes 4 (see FIG. 3) for defrosting the coil and to overflow standpipe 31, with outlet fitting 14, and overflow conduit 19 including transparent section 18, routed to the outlet 22 of drain pan 20. The elbow guards 25 which fully contain and confine the ends of coil 24 are partly removed to show the interior with clarity.

Figure 2:
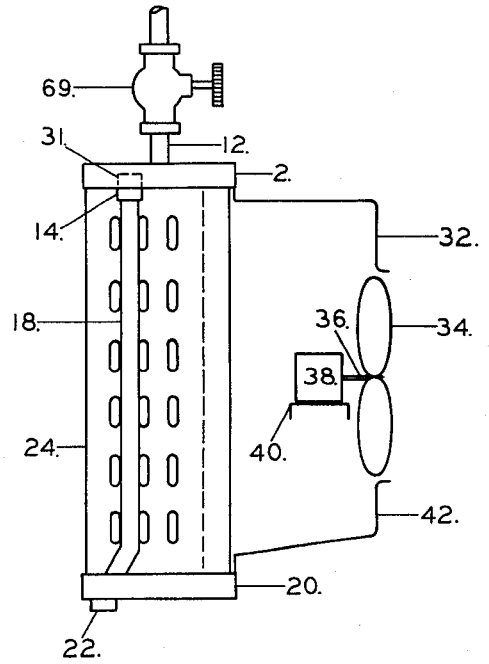
FIG. 2 is an end view and partial cross-section of the complete evaporator, including the distributor pan, the drain pan, the coil, the fan and the motor.

FIG. 2 is a side view of the same evaporator, which shows the fan section in cross-section. Fan casing 32 contains motor shelf 40 on which motor 38 is mounted. Motor 38 has shaft 36 on which the fan 34 is mounted. This fan section and fan is positioned to draw air over refrigerating coil 24 between defrosts. Shown also in end view are the distribution pan 2 with its inlet pipe 12, standpipe 31, and overflow conduit 19 with its transparent section 18. Hand valve 69 is positioned to control the flow of defrost water to inlet pipe 12.

Figure 3:
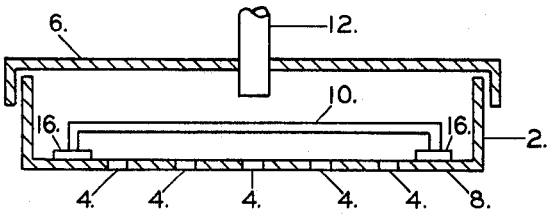
FIG. 3 is an end cross-sectional view of the water distributing pan of the evaporator showing an internal distributing pan and the distributing holes.

FIG. 3 is a cross section in elevation of the distribution pan 2 showing the pan itself, primary distributor 10, secondary distribution holes 4, located in the main distributor pan cover 6. The primary distributor 10 is positioned to receive the full force of the high velocity water stream entering through inlet pipe 12 and distributed over the periphery of the primary distributor 10 so that the velocity at each point of entry of water into the zone of the secondary distributing holes is substantially uniform to ensure the flow rate from each is in proportion to its size.

Figure 4:
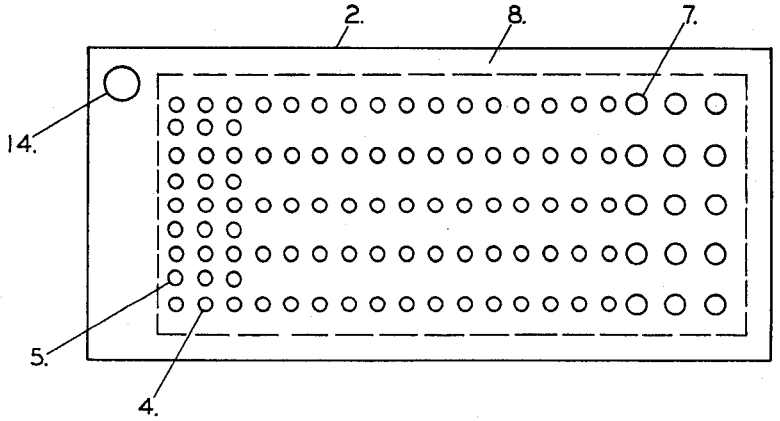
FIG. 4 is a bottom view of the water distribution pan showing the overflow pipe, the water distributing holes arranged for a larger flow at the ends than at the center.
Figure 5:
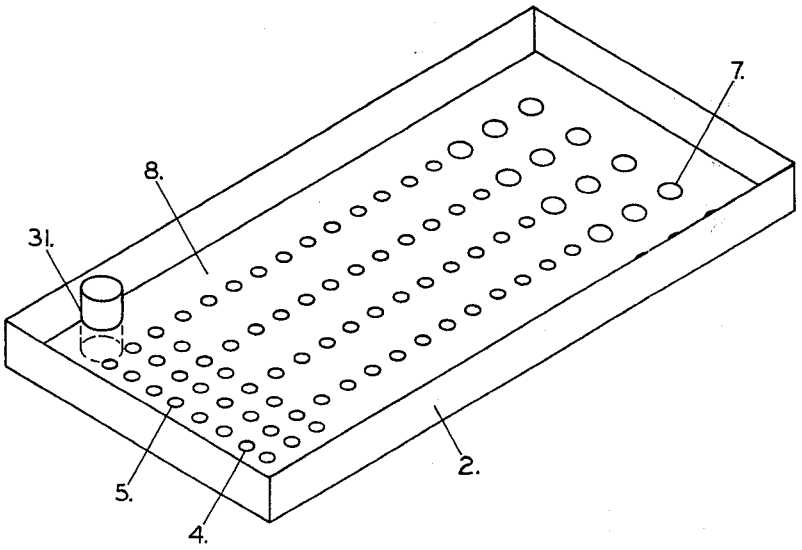
FIG. 5 is an isometric view of the distributing pan showing the distributing holes and the overflow.

FIG. 4 is a bottom view of distributing pan 2 viewed from the position which would normally be occupied by coil 24. Holes 4 are readily observed in a uniform pattern over the center portions of the coil. To increase the defrost water flow near the coil ends, the density of the hole pattern is increased at the lefthand end for increasing the unit rate of water delivery (gallons per minute per inch of coil) by the addition of additional holes 5 whose size is the same as holes 4. The same effect of increased water flow is achieved at the right-hand end of the distributing pan by the use of holes 7, whose diameter is larger than that of holes 4. By the use of more holes 4 for a coil portion or larger holes 4 for a coil portion, or both, or a combination, more water can be deliberately applied to one portion than another.

In operation a refrigeration system, not shown, connected to the evaporator of FIG. 1 is operated until there is sufficient frost deposited on the fin coil 24 to warrant stopping refrigeration nd and initiating a defrost. This condition may be detected by a frost detector of any sort or the defrost may be initiated by a time clock.

When the refrigeration has been stopped and the fans 34 (FIG. 2) stopped, a water flow through valve 69 is initiated. Valve 69 is opened by an operator until flow is observed in transparent section 18. At that condition the operator is assured that the pan has established within it a water depth equal to the height of the overflow standpipe 31 and that there is sufficient water flow to satisfy the demand of all the distributing holes 4 for defrosting the coil 24 and supply water to overflow pan 2 and flow through conduit 19 directly to drain 22 for defrosting it.

I claim:

1. An improved forced air cooling evaporator including a frosting coil comprising a bundle of substantially straight spaced apart tubes joined at their ends with U bends, said bundle having end portions adjacent the U bends and central portions; means for defrosting the coil by applying water to it, wherein the improvement comprises means for supplying water at a higher unit rate to an end portion and at a lower unit rate to a central portion to speed up the defrost rate of the end portion.

2. An evaporator as in claim 1 where the means for supplying water at different rates constitutes holes of substantially the same size with different numbers of holes per unit coil portion.

3. An evaporator as in claim 1 where the means for supplying water at a first rate employs holes of a first size and the means for supplying water at a second rate employs holes of a second size.

4. In a forced air cooling evaporator including a frosting coil comprising a bundle of substantially straight spaced apart tubes joined at their ends with U bends, and having end sections adjacent the U bends and a center section the method of defrosting said frosting evaporator coil constituting the steps of:

a. Applying water at a lower rate to a central portion, b. Applying water at a higher rate to an end portion to speed up the defrost rate of the end portion.

* * * * *